United States Patent [19]

Speraw et al.

[11] 4,158,130

[45] Jun. 12, 1979

[54] INTERCHANGEABLE AUXILIARY KEYBOARD

[75] Inventors: Floyd G. Speraw, Cambridge; Michael B. Sestina, Byesville; Paul L. Hittinger, Dayton, all of Ohio

[73] Assignee: NCR Corporation, Dayton, Ohio

[21] Appl. No.: 795,256

[22] Filed: May 9, 1977

[51] Int. Cl.[2] ..... G06C 7/02; G06C 25/00

[52] U.S. Cl. ..... 235/146; 235/145 R; 400/473

[58] Field of Search ..... 235/146, 145 R; 197/98, 197/102

[56] References Cited

U.S. PATENT DOCUMENTS

| | | | |
|---|---|---|---|
| 3,797,630 | 3/1974 | Zilkha | 235/145 R |
| 4,020,328 | 4/1977 | Bradam | 235/146 |
| 4,030,094 | 6/1977 | Anderson | 235/145 R |

FOREIGN PATENT DOCUMENTS

| | | | |
|---|---|---|---|
| 379706 | 8/1923 | Fed. Rep. of Germany | 235/146 |

*Primary Examiner*—Stephen J. Tomsky
*Attorney, Agent, or Firm*—J. T. Cavender; Wilbert Hawk, Jr.; Richard W. Lavin

[57] ABSTRACT

A low cost, self locating auxiliary keyboard assembly is disclosed for changing the key configuration and classification of the keyboard of a data terminal device, the assembly including a cover member having a plurality of apertures which overlie associated control keys on the keyboard of the data terminal device. A classification indicia card having a plurality of predetermined positioned apertures is placed on the cover member, the apertures in the indicia card overlying certain of the apertures in the cover member to allow a removable auxiliary key member to be inserted within the aligned apertures of both the indicia card and the cover member to engage the top portion of the associated control key on the keyboard of the data terminal device for operation thereby. Removing the auxiliary key members from the cover member allows other indicia cards to be located on the cover member thereby changing the configuration and classification of the keys of the keyboard allowing the keyboard to operate in different functional modes. Means are provided in the cover member which cooperate with the control keys on the keyboard to orientate and hold the cover member on the keyboard of the data terminal device.

14 Claims, 4 Drawing Figures

INTERCHANGEABLE AUXILIARY KEYBOARD

BACKGROUND OF THE INVENTION

The present invention is directed to data terminal devices in general and, more particularly, to the keyboard of the terminal devices. Data terminal devices are designed to be operated under the widest possible business conditions without requiring any modification to their structure. Many businesses include a number of different departments, each of which carry out business transactions which are unique to the nature of the business carried out in that department. An example of this is in modern day department stores where a large number of diverse business transactions are carried out. In these instances, it would be desirable to have a data terminal device which can be utilized in any of the departments located in the department store. Prior data terminal devices which have been used in this type of environment have required a different keyboard configuration which corresponds to the type of business or the accounting procedures carried out in the department in which the terminal device is to be used. This requirement has added to the cost of the terminal device and has prevented the use of other terminal devices having a different keyboard configuration in the case of a breakdown of the terminal device in that department. Various devices have been proposed in the prior art to overcome some of these problems. One example is shown in U.S. Pat. No. 2,625,330 issued to K. M. Buckey et al., and which is assigned to the assignee of the present application, the patent disclosing the use of a flexible member which is positioned over the control keys of an accounting machine, the flexible member containing indicia-bearing areas which are located substantially identical with the control keys of the accounting machine to change the classification of the control keys. This type of construction has been found not to work well on those keyboards where the keys are mounted in close proximity to each other, since depression of a portion of the flexible member will normally result in more than one control key being depressed. Other devices found in the prior art include a waterproof auxiliary keyboard which is placed on the keyboard of the terminal device and which prevents the disabling of the terminal device when water or other types of drinks and food have been accidentally spilled on the keyboard. An example of this type of construction is shown in U.S. Pat. No. 4,020,328 issued to W. R. Bradam and assigned to the assignee of the present application. This type of auxiliary keyboard requires the replacement of the entire auxiliary keyboard to change the key classification of the data terminal device. It is obvious that this is an added expense to the overall cost of the data terminal device.

It is therefore the principle object of the present invention to provide an auxiliary keyboard for a data terminal device which will operate under a number of different business environments or accounting procedures without requiring the replacement of the auxiliary keyboard device.

It is another object of this invention to provide an auxiliary keyboard for a data terminal device which is capable of having the number and location of the keys that are operable to be changed to accommodate different business environments.

It is a further object of this invention to provide an auxiliary keyboard which is capable of having the key classification indicia changed.

It is another object of this invention to provide an auxiliary keyboard for use with a data terminal device which is low-cost and capable of being used on a plurality of different data terminal devices.

SUMMARY OF THE INVENTION

In order to fulfill these objects, there is provided a low-cost auxiliary keyboard assembly which includes a rigid cover member having depending edge portion for mounting the cover member on the keyboard of a data terminal device. A plurality of tab members, having an edge configuration corresponding to the outer edge configuration of the control keys on the keyboard of the data terminal device, are located in the edge portion of the cover member for locating and holding the cover member on the keyboard. The cover member includes a plurality of apertures orientated to overlie an associated control key of the terminal device keyboard. Positioned on the top of the cover member is a classification indicia card having a plurality of predetermined positioned apertures, each of which aligns with a corresponding aperture in the cover member. Printed on the indicia card adjacent each of the apertures is an indicia describing the classification of the control key associated with that aperture. A replaceable auxiliary key member is slidably positioned within the apertures of the indicia card and the cover member, the auxiliary key member engaging the top of an associated control key in the terminal device keyboard for operation of the control key upon depression of the auxiliary key member. Each auxiliary key member is constructed of a flexible material so that when squeezed by the operator, the auxiliry key member will assume a configuration which allows it to be removed from the apertures in the indicia card and the cover member.

DESCRIPTION OF THE DRAWINGS

Additional advantages in features of the present invention will become apparent and fully understood from a reading of the following description taken together with the annexed drawing.

DESCRIPTION OF THE PREFERRED EMBODIMENT

Figure 1:
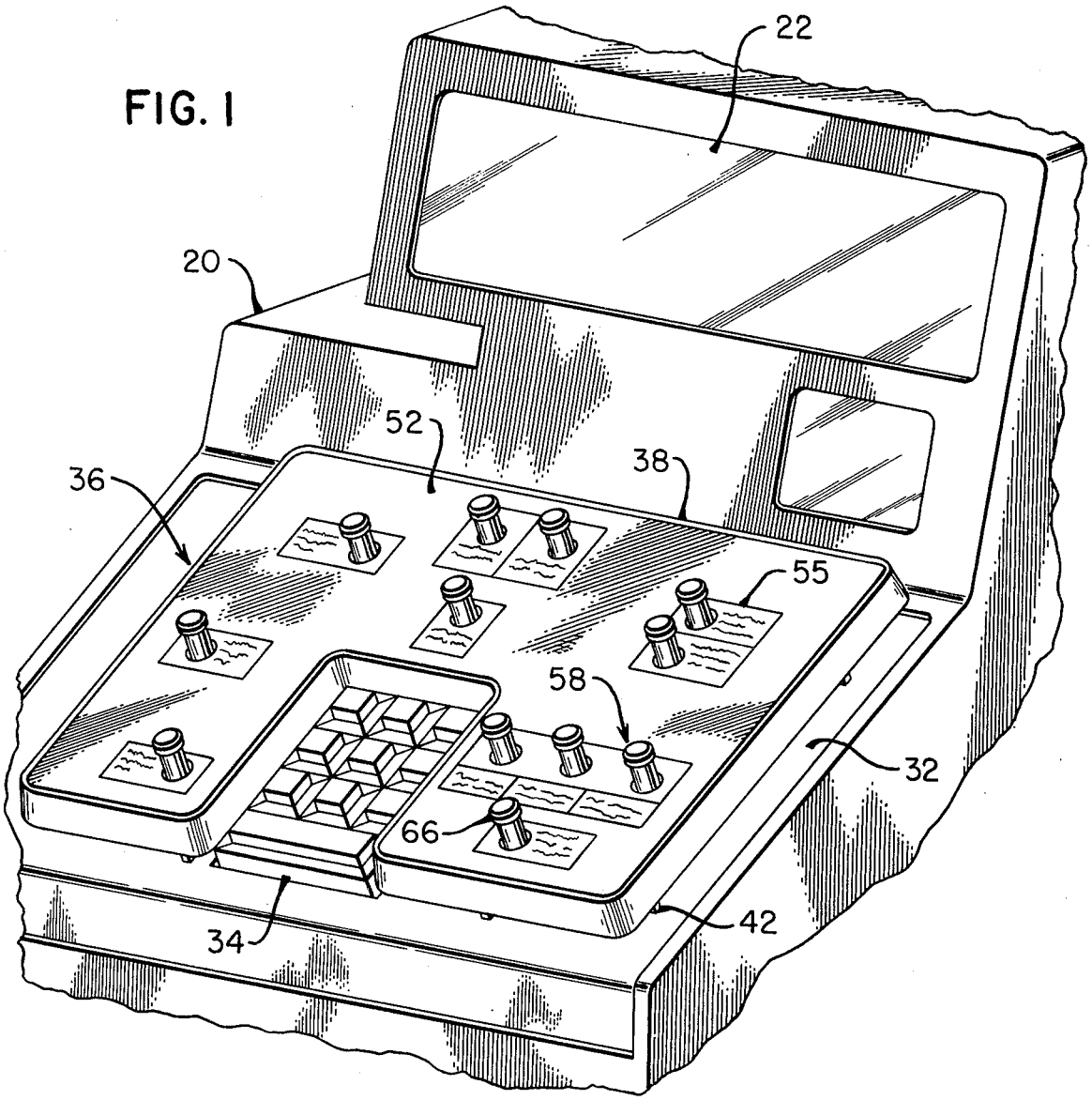
FIG. 1 is a perspective view of the auxiliary keyboard assembly positioned on the main keyboard of a data terminal device.

Referring now to FIG. 1 of the drawing, there is shown a perspective view of a data terminal device 20 which includes a conventional display panel 22 wherein information pertinent to the operation of the terminal is displayed. included in the terminal device 20 is a keyboard generally indicated by the numeral 24 (FIG. 2) which includes an array of control keys 26, each secured to a keystem 28 which extends within the keyboard portion of the terminal device, the control key 26 in each instance being mounted for movement in a manner well known in the art to introduce data into the terminal device.

Figure 2:
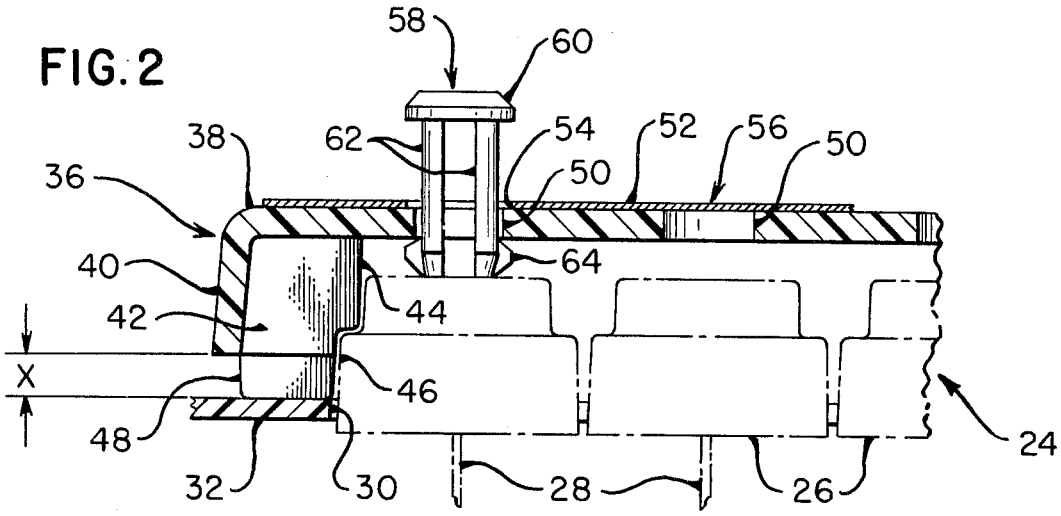
FIG. 2 is a partial cross-sectional view of the auxiliary keyboard and the main keyboard taken on line 2—2 of FIG. 3 showing details of the construction of the auxiliary keyboard, together with the removable auxiliary key member and the mounting tab portions.

As illustrated in FIG. 2, the control keys 26 extends through an aperture 30 located in a keyboard cover 32 which forms a portion of the terminal device 20. The control keys 26, utilized in the present embodiment, fall into two general functional categories. Included is a ten key section, generally indicated by the numeral 34 (FIG. 1), wherein the depression of the keys will introduce numerical data into the terminal device in a manner that is well known in the art. The remaining control keys 26 are classification keys which relate to the type of item that is being sold and transaction keys for controlling the operation of the data terminal device in a manner that is also well known in the art.

Figure 3:
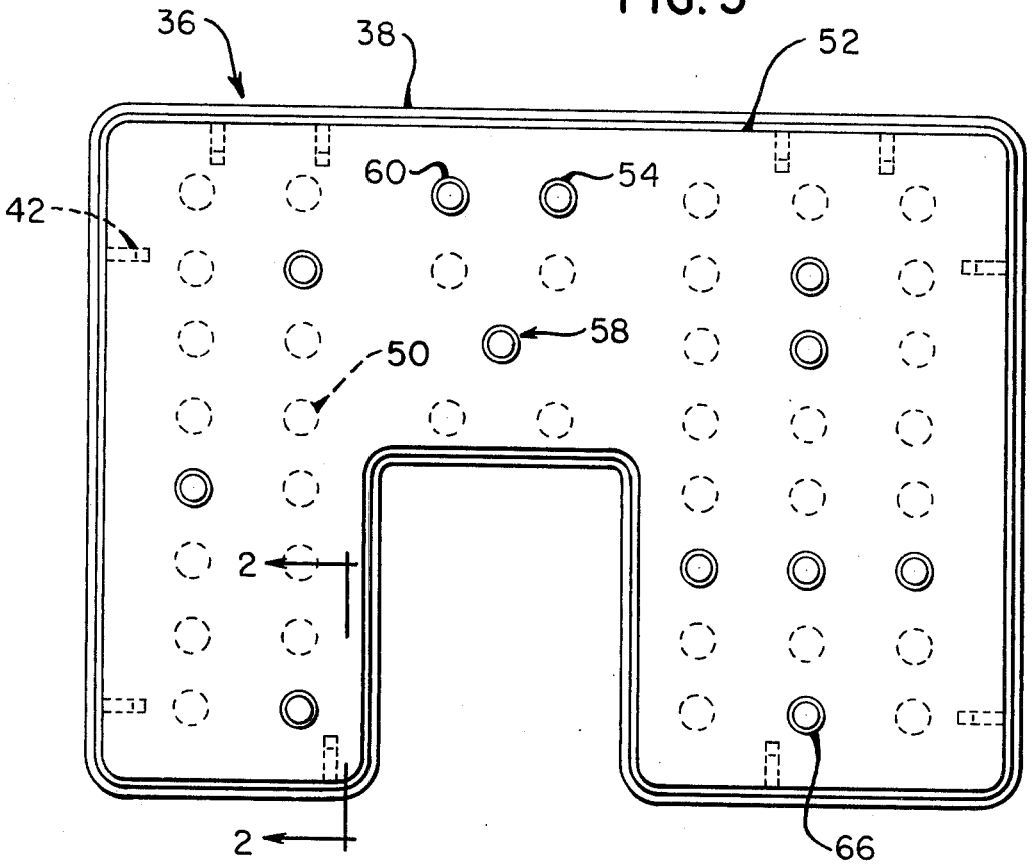
FIG. 3 is a plan view of one type of indicia card arrangement showing the member mounted on the auxiliary keyboard.

In accordance with the present invention, there is positioned over the keyboard 24, of the terminal device 20, an auxiliary keyboard, generally indicated by the numeral 36 (FIGS. 1–3), and which includes a cover member 38 having depending side portions 40 which may extend to a position adjacent the keyboard cover 32 of the main keyboard. As shown in FIGS. 2 and 3, secured along the edge of the keyboard cover member 38, are a plurality of depending tab portions 42 having an outer edge configuration 44 which conforms to the edge configuration 46 of an associated control key 26. Positioning the cover member 38 over the keyboard 24 will allow the tab members 42 to orientate and hold the cover member 38 on the keyboard 24 of the data terminal device.

As shown in FIG. 2, the tab member 42 has a depending lower portion 48 which extends below the edge portion 40 of the cover member 38 and which engages the keyboard cover 32. The dimension of this lower portion 48, as indicated by the numeral X in FIG. 2, can be varied to accommodate different heights of control keys 26 that may be found in different data terminal devices.

As seen more clearly in FIG. 2, located in the cover member 38 are a plurality of apertures 50 orientated to overlie an associated control key 26 in the terminal device keybord 24. As shown in FIGS. 1 and 3, the cover member 38 is formed in a generally U-shaped manner which, when placed over the main keyboard 24, allows the ten key section 34 of the terminal device keyboard 24 to be accessible to the operator for operation. The number of apertures 50 located in the cover member 38 correspond to the maximum number of control keys 26 that mey be mounted in the main keyboard 24 of the data terminal device 20.

Figure 4:
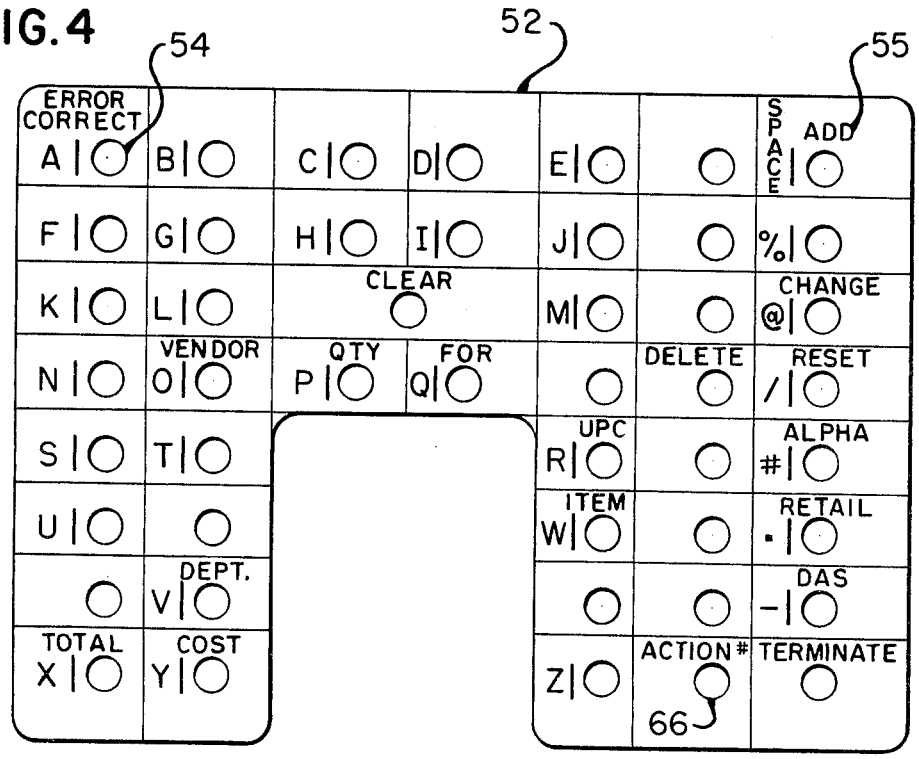
FIG. 4 is a plan view of another indicia card arrangement in accordance with the present invention.

Associated with the cover member 38 are a plurality of indicia card members 52 (FIGS. 1–4), each of which includes a number of predetermined positioned apertures 54, which, when positioned on the cover member 38, will overlie an associated aperture 50 in the cover member. As shown more clearly in FIGS. 1 and 4, the indicia card member 52, which may be of any type of construction such as cardboard, plastic, etc., has printed adjacent each of the apertures 54 indicia 55 describing the classification of the control keys 26 that is located beneath the aperture 54. In those instances where the function of the terminal device dictates that only a selected number of control keys 26 will be utilized in the functional operation of the keyboard, the indicia card member 52 will have an aperture 54 aligned with a corresponding aperture 50 in the cover member 38 to enable only those control keys 26, which are required to carry out the functional operation of the keyboard, to be operated while a solid portion 56 (FIG. 2) of the card member 52 will overlie the remaining apertures 50 of the cover member 38 corresponding to the control key 26 which are not required, thereby preventing any inadvertent operation of these keys by the operator. It is obvious that any number of indicia card members 52, each with a wide variety of aperture arrangement and different classification indicia may be used thereby providing a large number of functional keyboard operations which can be accommodated on a single keyboard of the terminal device.

The auxiliary keyboard assembly of the present invention includes a plurality of selectively positioned auxiliary key members, generally indicated by the numeral 58 (FIGS. 1–3 inclusive), which are slidably positioned within the apertures 50 and 54 so as to actuate the associated control key 26 located beneath said apertures. As shown more clearly in FIG. 2, each auxiliary key member 58 includes a key tip portion 60, a pair of spaced apart depending keystem portions 62 extending from said key tip portion 60, each keystem portion 62 having an abutment portion 64 located on its lower end and which cooperates with the lower edge of the aperture 50 of the cover member 38 to locate the keystem within said aperture. The auxiliary key member 58 is preferably constructed of a flexible plastic material such as polystyrene and copolymers of styrene, e.g., acrylonitrile-butadine styrene copolymers, which will allow the keystem portions 62 to be manually deflected towards each other thereby positioning the abutment portions 64 within the dimension of the aperture 50 allowing the removal of the auxiliary key members 58 to take place. There is provided with each of the keyboard cover members 38 a plurality of auxiliary key members 58 to allow one auxiliary key member 52 to be positioned within each aperture 50 located within the cover member 38.

In the operation of a data terminal device 20, the operator will place the keyboard cover member 38 on the main keyboard 24 of the terminal device. Depending on the functional requirements of the data terminal device, the operator will place on the cover member 38 an indicia card member 52 having the appropriate apertures 54 and indicia 55 in accordance with said functional requirements. The operator will then insert into each of the aligned apertures 54 and 50, located in the indicia card member 52 and cover member 38, respectively, a key member 58, said insertion being accomplished by grasping the two keystem portions 62 and pressing them towards each other to allow the abutment portions 64 to be inserted through the apertures 54 and 50 until they engage the top of the associated control key 26. Upon release of the keystem portions 62, the abutment portion 64 will then assume the position as shown in FIG. 2 allowing the key member 58 to be held by the cover member 38. The operator will then index into the ten key section 34 of the main keyboard 24 a predetermined code associated with the indicia card member 52 that has been placed on the cover member 38. After indexing the code in the ten key section 34, the operator will then depress an auxiliary key member 66 (FIGS. 1 and 3) associated with the indicia "Action." Depression of this auxiliary key member 66 will allow the softward located in a remote microprocessor, or other type of central processing unit, to decode the signals generated by the operation of any of the auxiliary key members 58 in accordance with the classification indicia printed on that particular card member 52. In the case where new indicia card member 52 is to be utilized, the prior card member is simply removed from a position on the cover member 38 since the key tip portions 60 of each of the key members 58 has a diameter which is less than the diameter of the aperture 54 located in the indicia card member 52. If the next indicia card member 52 is to accommodate a number of auxiliary key members 58 which is less than that used with the previous card member, the operator will remove those key members 58 which are not required by simply grasping the keystem portions 62 of the auxiliary key members 58 and squeezing them together to facilitate their removal from the cover member 38.

While the principles of the invention have now been made clear in an illustrated embodiment, it will be obvious to those skilled in the art that many modifications of structure, arrangements, elements and components can be made which are peculiarly adapted for specific environments without departing from those principles. The appended claims are therefore intended to cover and embrace any such modification within the limits only of the true spirit and scope of the invention.

What is claimed is:

1. In combination with a keyboard having key members therein, an auxiliary keyboard assembly adapted for positioning on the keyboard comprising:

(a) a cover member having defined portions for engaging and locating the cover member on the keyboard, said cover member having a plurality of first apertures each positioned over one of the key members;

(b) an indicia bearing member positioned on said cover member, said indicia member having a portion covering certain of said first apertures and further including a plurality of second apertures, each of said second apertures being in alignment with one of the other of said first apertures in said cover member;

(c) and a removable key actuating means slidably located in each of the aligned first and second apertures and extending through said aligned apertures to engage a corresponding key member for operating said key member upon actuation of said key actuating means.

2. The auxiliary keybord assembly of claim 1 wherein said defined portions of the cover member includes depending flange portions, and means secured to said flange portions for engaging the key members of the keyboard upon positioning of the cover member on the keyboard to hold the cover member on the keyboard.

3. The auxiliary keyboard assembly of claim 2 in which said engaging means comprises a tab member having an edge portion which engages the edge of one of the key members of the keyboard to hold the cover member on the keyboard.

4. The auxiliary keyboard assembly of claim 2 in which said indicia bearing member comprises a flat elongated member having said second apertures selectively positioned therein, said second apertures coacting with a corresponding first aperture in said cover member to enable the key member positioned adjacent said first aperture to be operated by said key actuating means.

5. The auxiliary keyboard assembly of claim 4 in which said flat elongated member includes a solid portion positioned adjacent one of said first apertures to disable the key member positioned adjacent the first aperture from operation.

6. The auxiliary keyboard assembly of claim 2 in which said removable key actuating means comprises an auxiliary key member adapted for inserting within aligned first and second apertures in said cover and indicia bearing member, respectively, said auxiliary key member engaging a key member in the keyboard for operation thereof upon actuation of said auxiliary key member.

7. The auxiliary keyboard assembly of claim 6 in which said auxiliary key member includes spaced apart flexible depending stem portions extending through said first and second apertures, said depending stem portions having abutment means secured thereto to engage the lower edge of said first aperture upon insertion of the auxiliary key member in said first and second aligned apertures to hold said auiliary key member in said cover member.

8. The auxiliary keyboard assembly of claim 7 in which said auxiliary key member includes a key tip member having a diameter less than the diameter of said second aperture in said indicia bearing member, whereby said auxiliary key member is removable from said cover member and said indicia bearing member upon movement of the stem portion of auxiliary key members to a position to allow the abutment means to move through said first and second apertures.

9. In combination with a data input device having a keyboard including a plurality of control key members for controlling the operation of the terminal device, an auxiliary keyboard assembly comprising:

(a) a rigid support member having defined surfaces for locating the support member on the keyboard;

(b) a plurality of first apertures located in said support member and positioned adjacent certain of said control key members upon locating the support member on the keyboard;

(c) means secured to said support member for engaging said control key members for positioning and holding said support members on the keyboard;

(d) an indicia bearing card member positioned on said support member, said card member having a predetermined number of second apertures selectively positioned therein, each of said second apertures aligned with certain of said first apertures in said support member;

(e) and removable key actuating means located in and extending through each of said aligned first and second apertures to engage one of said control key members for operating said control key member upon actuation of said key actuating means.

10. The auxiliary keyboard assembly of claim 9 in which said indicia bearing card member further includes non-aperture portions selectively positioned over certain of said first apertures preventing the insertion of said removable key actuating means in said covered first apertures.

11. The auxiliary keyboard assembly of claim 9 in which said positioning and holding means comprises vertically orientated tab members having an edge configuration similar to the edge configuration of said control key members, said tab members engaging the outer edge of said control key members to orientate and hold said support members on said keyboard.

12. The auxiliary keyboard assembly of claim 9 in which said removable key actuating means comprises an auxiliary key member having a deformable holding portion, said holding portion adapted to hold the key actuating means in said support member when in a non-deformed state upon insertion of the auxiliary key members through said aligned first and second apertures.

13. The auxiliary keyboard assembly of claim 12 in which said holding portion comprises a plurality of spaced apart flexible stem portions each having an abutment member positioned thereon, said stem portions being flexed to position the abutment member within said first and second aligned apertures to allow the auxiliary key member to move through said first and second aligned apertures.

14. A method for changing the number, and the arrangement together with the classification of a plurality of control keys on a single keyboard to allow the keyboard to be used in different business environments comprising the steps of (a) orientating a support member on the keyboard to position a first aperture in said support member adjacent each of said control keys;

(b) positioning an indicia bearing card member having a predetermined number of second apertures arranged in a predetermined configuration on said card on said support member wherein said second apertures are aligned with certain of said first apertures, said second apertures having classification indicia printed adjacent thereto;

(c) and inserting a removable key actuating member in each of said aligned first and second apertures to a position engaging a control key.

* * * * *